US006885142B2

(12) United States Patent
Ito

(10) Patent No.: US 6,885,142 B2
(45) Date of Patent: Apr. 26, 2005

(54) FUNNEL FOR COLOR CATHODE RAY TUBE

(75) Inventor: Shigeyoshi Ito, Otsu (JP)

(73) Assignee: Nippon Electric Glass Co., Ltd., Shiga-Ken (JP)

( * ) Notice: Subject to any disclaimer, the term of this patent is extended or adjusted under 35 U.S.C. 154(b) by 174 days.

(21) Appl. No.: 10/179,841

(22) Filed: Jun. 24, 2002

(65) Prior Publication Data

US 2004/0000859 A1 Jan. 1, 2004

(51) Int. Cl.[7] ..... H01J 9/26
(52) U.S. Cl. ..... 313/477 R; 220/2.1 A
(58) Field of Search ..... 313/477 R; 220/2.1 R, 220/2.1 A; 428/34

(56) References Cited

U.S. PATENT DOCUMENTS 6,169,588 B1 1/2001 Wakatsuki et al.
6,674,231 B1 * 1/2004 Eta ..... 313/477 R

FOREIGN PATENT DOCUMENTS

JP 04048536 2/1992
JP 07-95431 10/1995

* cited by examiner

*Primary Examiner*—Nimeshkumar D. Patel
*Assistant Examiner*—Glenn Zimmerman

(57) ABSTRACT

A funnel for a color cathode ray tube comprises a seal end surface to which a panel is sealed through a frit glass. An area occupying at least 50% of the seal end surface in a width direction is a rough surface. The rough surface satisfies conditions of $10 \leqq Rz \leqq 25$ $\mu$m and $2.5 < Sm/Rz \leqq 6.0$, where Rz is the ten point height of roughness profile in the width direction and Sm is the mean interval of profile peaks and profile valleys in the width direction. The rough surface comprises a plurality of dimple-like micro cavities formed by the profile peaks and the profile valleys.

1 Claim, 3 Drawing Sheets

FUNNEL FOR COLOR CATHODE RAY TUBE

BACKGROUND OF THE INVENTION

The present invention relates to a funnel for use in color cathode ray tubes.

Referring now to FIG. 3, the glass components of a color cathode ray tube includes a panel 1 on which a picture is projected and a funnel 3 that has a neck portion 2 where an electron gun is inserted.

The panel 1 and funnel 3 are sealed together through a frit glass 5 between the confronting seal end surfaces 4 thereof. For this sealing, the funnel 3 is held with the seal end surface 4 thereof facing up, and a slurry of mixture of an organic binder (so called "vehicle") and a crystalline frit glass is applied on the seal end surface 4. After the slurry is dried, the panel 1 is mounted, with the seal end surface 4 thereof facing down, onto the funnel 3 and then heated for sintering.

During this sealing process using a frit glass, a low-viscosity slurry of frit glass 5 should be uniformly applied on the seal end surface 4 of the funnel 3 as much as possible in view of coating performance and high sealing strength.

However, since the seal end surface 4 of the conventional funnel 3 is in the state of mirror-finished, when the slurry of frit glass 5 is applied much thereon, the frit glass 5 is not held on the seal end surface 4 but spills out from the seal end surface 4. As a result, the sealing portion has a so-called re-entrant shape where the frit glass 5 makes a small angle a, with the outer surface of the funnel 3 in the vicinity of the seal end surface 4. For this reason, the sealing strength between the panel 1 and the funnel 3 may be degraded, as a result, a fracture of the glass bulb may occur in the subsequent evacuation process during cathode ray tube manufacturing due to the degradation of the sealing strength. Thus, the applicant of the present invention proposed in Japanese Patent Publication No. Hei. 7-95431 a funnel for a cathode ray tube in which a seal end surface thereof was a rough surface having a plurality of micro dimple-like portions, so as to prevent a frit glass from spilling and to secure the frit glass on the seal end surface. As a result, it was possible to obtain a preferable sealing shape.

Meanwhile, further improvements are wished with regard to remains of micro foreign materials on the seal end surface and micro air bubbles in the sealing portion. Further, a funnel for a cathode ray tube having more excellent higher sealing strength is wished.

Specifically, in the funnel having the seal end surface of which is the rough surface, micro foreign materials such as organic materials, carbon or micro metallic powder adhere to the seal end surface during manufacturing or packing processes, and may remain in the dimple-like portions on the seal end surface even after the funnel has undergone the cleaning process. In other cases, since the frit glass applying on the seal end surface does not completely fill in the dimple-like portions during the sealing process, air remains in the dimple-like portions. When a high voltage is applied to a cathode ray tube using a glass bulb in which a funnel and a panel is sealed together in the state of micro foreign materials, dirt or the like remaining on the seal end surface, electric charge may concentrate on the micro foreign materials or dirt are adhered. In the case of air remaining in the dimple-like portions, micro bubbles may be generated in the sealing portion. As a result, it is not able to obtain a cathode ray tube having a predetermined sealing strength and performance. For sealing the panel and the funnel made of glass with each other, these glass components are heated and sintered usually at temperatures of 450° C. or lower so as to minimize deformations thereof. In this process, ZnO—PbO—$B_2O_3$ crystalline frit glass, for example, is employed to prevent softening of the sealing portion including the frit glass in the subsequent evacuation process (maximum temperature is about 350° C.) during a cathode ray tube manufacturing.

This crystalline grit glass begins softening and flowing at about 400° C. by heating, and crystals of $4PbO \cdot B_2O_3$ and $2ZnO \cdot PbO \cdot B_2O_3$ are precipitated in the frit glass, and then the frit glass changes into a crystalline glass superior in heat-resistance thermal expansion coefficient which is compliant with that of the funnel glass (approximately $100 \times 10^{-7}$/°C.) via a 30–60 min sintering at about 440° C. In the boundary between the frit glass and funnel glass, the frit glass reacts with the glass of the seal end surface of the funnel while crystallizing and erodes the glass by the wedging effect to form a chemical bonding for sealing. The adhesive strength of frit glass is determined by the degree of reaction and erosion between the frit glass and the funnel glass. For examining the degree of adhesion between the funnel glass and the frit glass, we may observe the state of formation of grains like rice-grains (hereafter, called "R grains") formed on the surface of the seal end surface, that is the boundary between the funnel glass and the frit glass, due to the reaction of the crystals of frit glass, after solving away the ingredients of the frit glass with strong acids like nitric acid. For providing a high sealing strength, the R grains must be formed finely with chaining structure on the surface of the funnel glass. The R grains present in almost needle shapes, approximately 5–30 $\mu$m in major dimension and approximately 1–10 $\mu$m in minor dimension. The fret glass after sintering presents the state of crystallized glass containing crystalline and non-crystalline phases. Since the ratio of the crystalline volume dependent on the state of formation of the R grains is a primary factor that determines the thermal expansion coefficient of the frit glass, it is important that the R grains are formed finely with chaining structure as much as possible, in order that the frit glass has an appropriate thermal expansion coefficient corresponding the funnel glass. Generation of the micro bubbles in the sealing portion becomes to be a great impediment for the formation of the R grains during the sealing process, so that there arises such problem that an appropriate expansion coefficient of the frit glass as well as high sealing strength and good sealing shape can not be obtained.

SUMMARY OF THE INVENTION

An object of the present invention is, therefore, to provide a funnel for color cathode ray tube that has a good sealing shape and an excellent sealing strength, by solving such problems that micro foreign materials and dirt remain on a seal end surface and micro bubbles generate in a sealing portion, and making a sufficient reaction occur in the boundary between frit glass and funnel glass during sealing process, while keeping a secure hold-ability for frit glass on the seal end surface.

To attain the above object, the present invention provide a funnel for a color cathode ray tube comprising a seal end surface to which a panel is sealed through a frit glass, wherein an area occupying at least 50% of the seal end surface in a width direction is a rough surface, the rough surface satisfying conditions of $10 \leqq Rz \leqq 25$ $\mu$m and $2.5 < Sm/Rz \leqq 6.0$, where Rz is the ten point height of roughness profile in the width direction and Sm is the mean interval of profile peaks and profile valleys in the width direction, and wherein the rough surface comprises a plurality of dimple-like micro cavities formed by the profile peaks and the profile valleys.

FIG. 5 shows the roughness profile in the width direction of the rough surface 6 of the seal end surface of the funnel. The rough surface 6 comprises profile peaks 6*a* which are convex with respect to the mean line m, and profile valleys 6*b* which are concave with respect to the mean line m, and a plurality of micro dimple-like cavities 6*c* which are formed by the profile peaks 6*a* and the profile valleys 6*b*. With regard to such rough surface 6, the ten-point height of roughness profile Rz, that is ten-point average roughness of the profile peaks and the profile valleys, and the mean width of the profile element Sm, that is average width between the profile peaks and the profile valleys, are defined as follows according to the way and definition provided by Japanese Industrial Standards (JIS) B0601-1994.

The ten-point height of roughness profile Rz is given by sampling a sampling length L along the mean line m from the roughness profile, and summing up the average value of the absolute heights of the highest peak to fifth highest peak and the average value of the absolute depths of the deepest valley to fifth deepest valley. Thus, Rz is expressed by the summed value in $\mu$m (see the following equation).

$$Rz=(|Y_{P1}+Y_{P2}+Y_{P3}+Y_{P4}+Y_{P5}|)/5+(|Y_{V1}+Y_{V2}+Y_{V3}+Y_{V4}+Y_{V5}|)/5$$

The mean interval of profile peaks and profile valleys Sm is given by sampling a sampling length L along the mean line m from the roughness profile, summing up each length of the mean line m corresponding to one profile peak and one profile valley neighboring thereto, and averaging the summed value. Thus, Sm is expressed by the average value in mm, in this invention, however, the average value is expressed in $\mu$m (see the following equation)

$$Sm=(Sm_1+Sm_2+\ldots+Sm_i+\ldots Sm_n)/n$$

When measuring the ten-point height of roughness profile Rz and the mean interval of profile peaks and profile valleys Sm according to the way and definition as mentioned above, the sampling length L is not less than 0.8 mm, an evaluation length Ln is not less than 4 mm, the vertical axis magnification is 1000–10000 times and the horizontal axis magnification is 10–50 times.

According to this invention, since the seal end surface comprises the dimple-like cavities 6*c* formed by the profile peaks 6*a* and the profile valleys 6*b* of the rough surface 6 the ten point height of roughness profile Rz of which is $10 \leqq Rz \leqq 25$ $\mu$m, a frit glass slurry applied thereon penetrates in the cavities 6*c* and is held therein, thereby the spilling of the frit glass is suppressed. Furthermore, the viscosity of the slurry becomes higher by a drying action advanced during the sealing process so that the flow of the slurry is more suppressed. Thus, the frit glass is held, without spilling, in a shape hardly causing a thermal stress. As a result, the excellent sealing shape is obtained.

If $Rz<10$ $\mu$m, the penetration of frit glass into the cavities 6*c* is shallow since the cavities 6*c* are not sufficiently deep. Therefore, the secure hold-ability for the frit glass is not obtained so that the spill thereof is easy to occur. Meanwhile, the seal end surface is easy to be scratched because it contacts with conveyers, packing materials or micro foreign materials such as dust or the like adhering thereto, during conveying process or packing process of the funnel. If the cavities 6*c* are shallow, the scratches tend to be formed in the state of passing through the seal end surface in the width direction. Such scratches on the seal end surface may cause a fracture of the glass bulb during the sealing process or the evacuation process, and also lead to the problem of a vacuum leak in the cathode ray tube.

On the other hand, if $Rz>25$ $\mu$m, there arise a difference in temperature distribution between the profile peaks 6*a* and profile valleys 6*b* on the seal end surface in an atmosphere during sintering in the sealing process. Thereby, the speed of softening flow of frit glass applied on the seal end surface differs between the profile valleys 6*b* and the profile peaks 6*a*, so that the frit glass does not uniformly penetrate in or react with the seal end surface. As a result, the expected sealing shape or sealing strength is not attained.

In this invention, the rough surface further satisfies the condition of the mean interval of profile peaks and profile valleys Sm as given by $2.5<Sm/Rz \leqq 6.0$, in addition to the ten point height of roughness profile Rz as mentioned above. Therefore, the profile peaks 6*a* and the profile valleys 6*b* forming the rough surface 6 have average slope suitable for the formation of the R grains in the frit glass and for filling of the frit glass slurry in the cavities 6*c*, so that the softened frit glass uniformly flows to penetrate in the cavities 6*c*, and the R grains of predetermined size are formed finely with chaining structure in close formation on the slopes of the profile peaks 6*a* and the profile valleys 6*b*.

If $Sm/Rz \leqq 2.5$, the viscous slurry of frit glass is difficult to fill in the cavities 6*c*, so that air remains in the cavities 6*c* to generate micro bubbles in the sealing portion. Thereby, the formation of the R grains is prevented. Thus, the formation of the R grains is easy to not be in close formation with chaining structure but be in lax formation. If the formation of the R grains is lax, the thermal expansion coefficient of the frit glass does not conform to that of the funnel glass, and the wedging function due to crystallization of frit glass is insufficient, because of insufficient reaction in the boundary between the frit glass and the funnel glass. Therefore, it is feared that a low sealing strength is merely obtained. Moreover, since the contact area between the seal end surface of the funnel and the frit glass becomes large, the reaction time for the frit glass and the funnel glass should be extended to attain the predetermined sealing strength in the sealing process, thereby the time required for sealing work is prolonged. As a result, work efficiency and productivity decline. In addition, micro foreign materials and dirt adhered on the seal end surface in the funnel manufacturing process become difficult to remove. If a high voltage is applied by an electron gun to a cathode ray tube using a glass bulb in which micro foreign materials and dirt remain in the cavities 6*c* on the rough surface, electric field concentrates on foreign materials or dirt may occurs, therefore, it is feared that cracks grow in the boundary between the funnel glass and the frit glass in the vicinity of the seal end surface, resulting in a dielectric breakdown.

On the other hand, if $Sm/Rz>6.0$, since the average slope of the profile peaks 6*a* and the profile valleys 6*b* forming the rough surface 6 becomes too smooth, the frit glass is likely to be forced out excessively when the panel is mounted onto the seal end surface of the funnel to which the frit glass has been applied, so that a re-entrant sealing shape is likely to present. In addition, the sealing strength may decline because the contact area between the seal end surface and the frit glass becomes small.

Considering the above situations, the ratio between the ten point height of roughness profile Rz and the mean interval of profile peaks and profile valleys Sm is determined at $2.5<Sm/Rz \leqq 6.0$, more preferably $3.5 \leqq Sm/Rz \leqq 5.0$.

In order to ensure the effects provided by the present invention, it is necessary that the rough surface having the plurality of dimple-like micro cavities meeting the above Rz and Sm/Rz occupies at least 50% of the seal end surface in the width direction.

The methods for forming the rough surface having the plurality of dimple-like micro cavities on the seal end surface of the funnel are not specified in the present invention; however, it will be a convenient and preferable way to lap the surface mechanically in one step or a few steps with slurry containing abrasives, for forming desired profile peaks, valleys and cavities, while suppressing the formation of unnecessary lapping scratches. Mechanical treatments may be also adopted, such as roughly grinding of the surface with a diamond wheel or blasting of the surface with a hard material such as alumina. Further, Rz and Sm of the rough surface can be controlled by chemical treatments using glass-erosive solutions such as hydrofluoric acid and acid ammonium fluoride after the mechanical treatment.

DETAILED DESCRIPTION OF THE PREFERRED EMBODIMENTS

Now the embodiments of the present invention will be described below with reference to the accompanying drawings. The members and portions being substantially the same as those described earlier in this specification have the same numerals and symbols throughout the figures.

Figure 1:
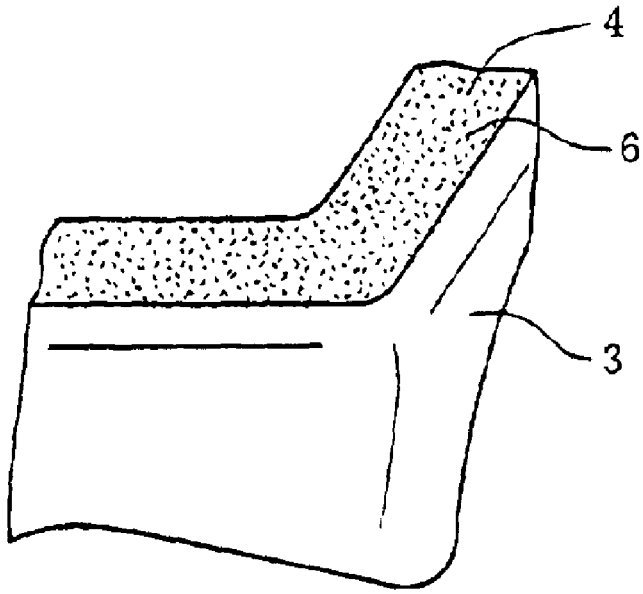
FIG. 1 is an enlarged perspective view of a part of a seal end surface of a funnel for a color cathode ray tube in accordance with an embodiment of the invention.
Figure 5:
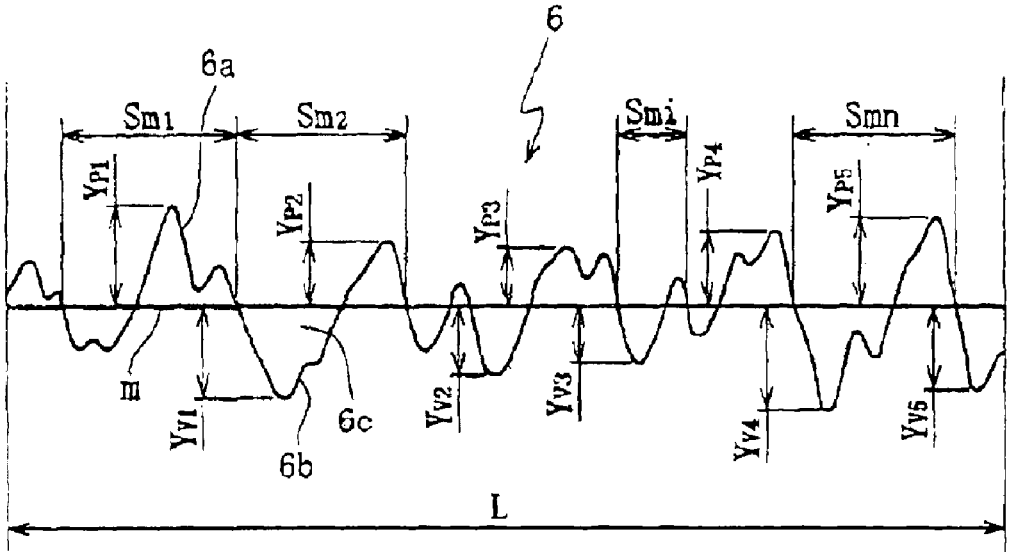
FIG. 5 is an enlarged sectional view of a rough surface of the seal end surface of the funnel for a color cathode ray tube in accordance with the embodiment of the invention.

FIG. 1 is an enlarged perspective view of a part of a funnel 3 for a color cathode ray tube in accordance with an embodiment. The funnel 3 has a rough surface 6 extending whole circumference of a seal end surface 4. Rz and Sm of the rough surface 6 meet the conditions of $10 \leqq Rz \leqq 25$ $\mu$m and $2.5 < Sm/Rz \leqq 6.0$ in the width direction thereof. As shown in FIG. 5, the rough surface 6 has profile peaks 6*a* that are convex with respect to a mean line m, profile valleys 6*b* that are concave with respect to the mean line m and a plurality of dimple-like micro cavities 6*c* formed by the profile peaks 6*a* and the profile valleys 6*b*.

Such rough surface 6 can be made by, for example, pressing the seal end surface 4 of the funnel 3 onto a rotating grind table, and grinding the seal end surface 4 under a constant load, while supplying an abrasive slurry in which alundum abrasives (major component is $Al_2O_3$) of a predetermined grain-size distribution are dispersed in water. After grinding, the funnel 3 is washed with water and then dried to provide the seal end surface 4 having the rough surface 6 of a desired surface condition.

It is important that the cavities 6*c* on such rough surface 6 are not in the shape of continuous lines or grooves extending across both edges of the seal end surface 4 of the funnel 3, but in the shape of independent form with each other. If the cavities are in the shape of continuous lines or grooves extending across the both edges of the seal end surface 4 of the funnel 3, it becomes difficult to completely a fill frit glass 5 in all the line-like or groove-like cavities. As a result, there may be a fear of vacuum leak or the like in the cathode ray tube the inside of which is evacuated.

Figure 2:
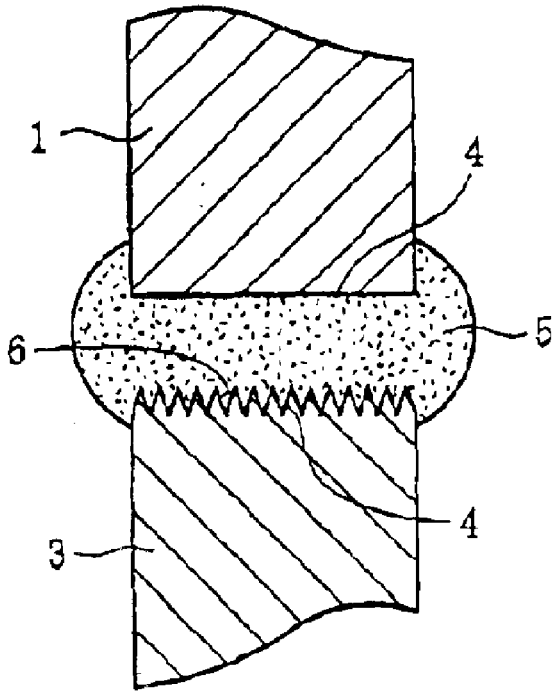
FIG. 2 is an enlarged sectional view of a sealing portion sealed by using the funnel for a color cathode ray tube in accordance with the embodiment of the invention.
Figure 3:
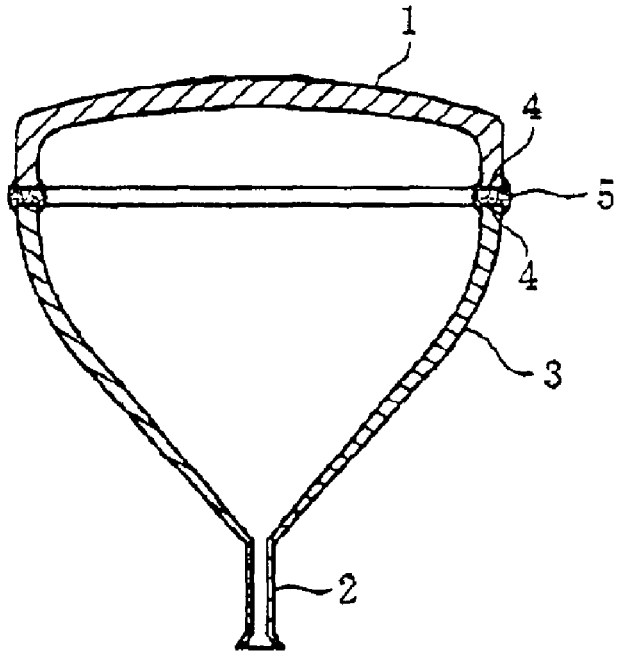
FIG. 3 is a sectional view of a color cathode ray tube funnel in which the funnel sealed with a panel.
Figure 4:
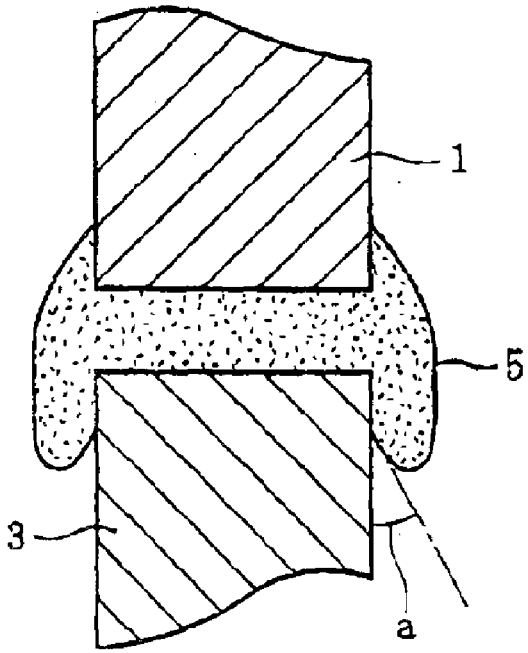
FIG. 4 (PRIOR ART)
FIG. 4 is an enlarged sectional view of the sealing portion by using a conventional funnel for a color cathode ray tube.

FIG. 2 illustrates that the funnel 3 for a color cathode ray tube, which comprises the seal end surface 4 having such rough surface 6, is sealed with the seal end surface 4 of a panel 1 through the frit glass 5. The slurry-like frit glass 5 applied onto the seal end surface 4 of the funnel 3 penetrates into the cavities 6*c* of the rough surface 6 on the seal end surface 4 to be suppressed in spilling, thereby the frit glass 5 is securely held on the seal end surface 4 of the funnel 3. Thus, it becomes possible to form the sealing portion in an excellent shape, between the seal end surface 4 of the funnel 3 and the seal end surface 4 of the panel 1 mounted thereon.

With respect to the seal end surface 4 of the funnel 3, since the,frit glass 5 is easy to penetrate sufficiently into the cavities 6*c*, the hold-ability for the frit glass 5 is secured, moreover air is prevent to remain in the cavities 6*c* so that micro bubbles is prevent to generate. Further, in the sealing process, it becomes possible to provide the R grains having denseness and desired grain size without impairing crystallization of the frit glass 5 and formation of the R grains. Therefore, it is possible to obtain an excellent and strong sealing strength through sufficient reaction in the boundary between the frit glass 5 and the seal end surface 4 of the funnel 3.

Rz, Sm and Sm/Rz of the seal end surface of the funnel for a cathode ray tube, according to embodiments 1–4 of the present invention and comparative examples 1 and 2, are shown in Tables 1, 2.

The funnels each of which had an aspect ratio of 4:3, a diagonal dimension of 724 mm, a seal end surface width of 12 mm and a deflection angle of 110°, were used in the embodiments and comparative examples. In the embodiments and the comparative example 1, the rough surfaces were formed by the aforementioned grinding methods with varying the grain-size distribution of alundum abrasives or varying the density of abrasives in the slurry with each other. Meanwhile in the comparative example 2, the seal end surface of the funnel was pressed onto the rotating diamond wheel table of a grinder under a constant load to grind.

In the tunnels of the embodiments and comparative examples, the ten point height of roughness profile Rz and the mean interval of the profile peaks and profile valleys Sm of the rough surface of the seal end surface were obtained by measuring surface roughness of portions of the seal end surface of the funnel on minor axis SA, major axis LA and diagonal axis DA, under the way and definition defined in Japanese Industrial Standards (JIS) B0601-1994. A roughness measurement device SE-3AK (manufactured by K. K. Kosaka Kenkyusho) was employed to measure surface roughness, with sampling length L=0.8 mm, evaluation length Ln=8 mm, vertical magnification 2000 times and horizontal magnification 20 times. The measurements were performed at the central portions in the width direction of the seal end surface on the minor axis, major axis and diagonal axis.

TABLE 1

| | Embodiment 1 | | | Embodiment 2 | | |
|---|---|---|---|---|---|---|
| | SA | LA | DA | SA | LA | DA |
| Rz (μm) | 22.2 | 21.2 | 22.2 | 16.7 | 14.5 | 17.2 |
| Sm (μm) | 94.1 | 100.1 | 82.5 | 72.7 | 71.4 | 74.7 |
| Sm/Rz | 4.2 | 4.7 | 3.7 | 4.4 | 4.9 | 4.3 |
| | Embodiment 3 | | | Embodiment 4 | | |
| | SA | LA | DA | SA | LA | DA |
| Rz (μm) | 12.0 | 13.5 | 11.3 | 24.1 | 23.7 | 23.2 |
| Sm (μm) | 66.1 | 72.9 | 64.4 | 72.3 | 73.5 | 71.9 |
| Sm/Rz | 5.5 | 5.4 | 5.7 | 3.0 | 3.1 | 3.1 |

TABLE 2

| | Comparative example 1 | | | Comparative example 1 | | |
|---|---|---|---|---|---|---|
| | SA | LA | DA | SA | LA | DA |
| Rz (μm) | 19.7 | 21.5 | 16.5 | 13.0 | 14.1 | 12.5 |
| Sm (μm) | 13.4 | 17.9 | 15.5 | 97.5 | 100.8 | 97.5 |
| Sm/Rz | 0.68 | 0.83 | 0.94 | 7.5 | 7.2 | 7.8 |

In each of the embodiments and comparative examples, the seal end surface of the funnel was held face up, and the slurry of frit glass was uniformly applied thereon, followed by drying. The slurry of frit glass was a mixture of a vehicle that was a solution of amyl acetate and nitrocellulose, and frit glass (manufactured by Asahi Glass K. K., ASF-1307B). A twelve-to-one blend of the frit glass and the vehicle in weight was sufficiently mixed and kneaded.

In the next step, glass panels for cathode ray tubes were prepared, each of which had the same dimension as the funnel (diagonal dimension 724 mm, width of the seal end surface 12 mm) and had almost flat outer surface of a radius of curvature of 40000 mm in the diagonal direction. Each of the panels was mounted on each of the funnels of the embodiments and comparative examples, with seal end surface thereof down, and the panel and the funnel were heated up to 440° C. for 30 minutes in an electric furnace for sintering to provide a glass bulb for a cathode ray tube in which the panel and the funnel were sealed with each other.

Table 3 shows the measurement and observation results of the pressure resistance of each glass bulb obtained in this way, the state of the formation of the R grains on the seal end surface of the funnel glass and the shape of the sealing portion.

The pressure resistance was determined by a water pressure method comprising the steps of filling water in the glass bulb, making the water pressure arise, and measuring the water pressure at which the glass bulb had fractured. In general, for a cathode ray tube the inside of which is evacuated, the pressure resistance thereof is required to be at least 2.5 times the atmospheric pressure, namely, 0.25 MPa, considering the long term resistance to the exposure to atmospheric pressure after evacuating and an increase in thermal stress augmented during the evacuation process or the like. Actually, the glass bulb is preferable to have more high pressure resistance as far as possible, because the value of the thermal vacuum stress is most greatly and the sealing portion between the funnel and the panel is influenced most by a local thermal stress concentration or the like on the glass bulb. In the pressure resistance measurement for the glass bulbs using the funnels of the embodiments and comparative examples, the starting point of the fracture in each of the glass bulbs generates in the sealing portion.

The state of the formation of the R grains was observed by the method comprising the steps of cutting out the center portion on the minor axis of the seal end surface of the glass bulb using the funnel of each of the embodiments and comparative examples, dissolving for removing only the frit glass (defrit) on the seal end surface with a 10% nitric acid solution under a ultrasonic vibration, and observing with a microscope the state of the formation of the R grains formed on the seal end surface of the funnel glass. In the table, the mark circle (○) is given when the R grains are formed finely with chaining structure over all the seal end surface of the cut out specimen, while the mark cross (X) is given when the formation of the R grains are not finely or without chaining structure.

With respect to the shape of the sealing portion, the result of the observation which was performed to the shape of the forced out portion of the frit glass in the sealing portion of the glass bulb using the funnel of each of the embodiments and comparative examples is shown in the table. For this observation, ten glass bulbs each for the respective embodiments and comparative examples were manufactured, and the number of glass bulbs showing faulty re-entrance shapes was counted by visual observation of the shape for the sealing portion.

TABLE 3

| | Pressure resistance (MPa) | Formation of the R grains | Shape of Sealing |
|---|---|---|---|
| Embodiment 1 | 0.59 | ○ | 0/10 |
| Embodiment 2 | 0.59 | ○ | 0/10 |
| Embodiment 3 | 0.56 | ○ | 0/10 |
| Embodiment 4 | 0.51 | ○ | 0/10 |
| Comparative example 1 | 0.39 | X | 0/10 |
| Comparative example 2 | 0.44 | ○ | 2/10 |

In the funnels according to the embodiments 1–4, the formation and growth of the R grains was sufficiently made and the sealing portion presented a good sealing shape without re-entrance, therefore, with high sealing strength. As a result, the glass bulbs for a cathode ray tube using such funnels were high in pressure resistance.

In contrast, according to the funnel of the comparative example 1, micro bubbles were generated in the sealing portion and the R grains did not grow sufficiently. As a result, the glass bulbs using such funnels were lower in pressure resistance, compared with the bulbs of the embodiments. Some of the funnels of the comparative example 2 presented sealing shapes with re-entrants in which the frit glasses made small angles with the outer surfaces in the vicinity of the seal end surfaces. The glass bulbs using such funnels presented less pressure resistances than the glass bulbs of the embodiments, As described so far, the funnel for a cathode ray tube according to the present invention solves the problems that micro foreign materials or dirt remain on the seal end surface and micro bubbles are generated in the sealing portion, while keeping a secure hold-ability for the frit glass on the seal end surface. Furthermore, since the reaction proceeds sufficiently in the boundary between the frit glass and the funnel glass during the sealing process, the sealing portion presents a preferable sealing shape and an excellent sealing strength, compared with the conventional sealing portion. As a result, a fracture of a glass bulb can be more decreased during the cathode ray tube manufacturing and thereby production yield becomes higher.

What is claimed is:

1. A funnel for a color cathode ray tube comprising a seal end surface to which a panel is sealed through a frit glass, wherein an area occupying at least 50% of the seal end surface in a width direction is a rough surface, the rough surface satisfying conditions of $10\,\mu m \leqq Rz \leqq 25\,\mu m$ and $2.5 < Sm/Rz < 5.0$, where Rz is the ten point height of roughness profile in the width direction and Sm is the mean interval of profile peaks and profile valleys in the width direction, and wherein the rough surface comprises a plurality of dimple-like micro cavities formed by the profile peaks and the profile valleys.

* * * * *